US008485423B2

(12) United States Patent
Thomas et al.

(10) Patent No.: US 8,485,423 B2
(45) Date of Patent: Jul. 16, 2013

(54) PRODUCT CONTAINER AND DISPENSER

(75) Inventors: Laurel Thomas, Richmond, VA (US); William Bogdziewicz, Raleigh, NC (US); Aaron L. Bates, Moseley, VA (US)

(73) Assignee: MeadWestvaco Corporation, Richmond, VA (US)

( * ) Notice: Subject to any disclaimer, the term of this patent is extended or adjusted under 35 U.S.C. 154(b) by 397 days.

(21) Appl. No.: 12/896,944

(22) Filed: Oct. 4, 2010

(65) Prior Publication Data

US 2012/0080513 A1 Apr. 5, 2012

(51) Int. Cl.
*B65D 1/26* (2006.01)
*B65D 5/54* (2006.01)

(52) U.S. Cl.
USPC ..... 229/200; 229/120.26; 221/302

(58) Field of Classification Search
USPC ..... 229/117.09, 223, 120.02, 120.08, 229/120.14, 120.15, 120.24
See application file for complete search history.

(56) References Cited

U.S. PATENT DOCUMENTS

| | | | | |
|---|---|---|---|---|
| 4,138,052 | A * | 2/1979 | Torigian | 229/120.32 |
| 5,020,719 | A * | 6/1991 | Roth et al. | 229/122.1 |
| 7,413,101 | B2 | 8/2008 | Smalley et al. | |
| 7,726,515 | B2 * | 6/2010 | Sherman et al. | 221/309 |
| 7,743,944 | B2 | 6/2010 | Ho Fung et al. | |
| 7,743,972 | B2 | 6/2010 | Fogle | |
| 7,762,451 | B2 | 7/2010 | Harrelson | |
| 7,806,313 | B2 | 10/2010 | Philips | |
| 2006/0027639 | A1 * | 2/2006 | Rasmussen | 229/122.1 |
| 2006/0249529 | A1 | 11/2006 | Smalley et al. | |

* cited by examiner

*Primary Examiner* — Gary Elkins
*Assistant Examiner* — Christopher Demeree
(74) *Attorney, Agent, or Firm* — Walters & Wasylyna LLC

(57) ABSTRACT

A product container and dispenser including a housing having a plurality of walls that define an internal volume, a first wall of the housing defining an opening into the internal volume, and a partition structure positioned in the internal volume, the partition structure including a sealing wall aligned with the first wall and a partition wall connected to the sealing wall, wherein the opening is at least partially obstructed by the sealing wall.

19 Claims, 8 Drawing Sheets

PRODUCT CONTAINER AND DISPENSER

FIELD

This application relates to apparatus and systems for containing and dispensing products and, more particularly, to stand-alone containers capable of housing and dispensing various products, such as canned foods.

BACKGROUND

Products are typically shipped to retailers in bulk by enclosing multiple individual product units in a container such as a carton or box. For example, canned soup may be shipped to a retailer in a box containing multiple cans. Then, a stock clerk typically removes the individual product units from the container and stacks them on a display unit, such as a shelf, thereby making the products available to consumers.

The process of removing products from shipping containers and stacking the products on a shelf can be quite time consuming. Specifically, the traditional package-ship-unpack-display model requires a stock clerk to obtain a package from the supplier, open the package, remove all of the product units from the open package, and stack each of the product units on a display unit. In the case of small, high volume products, such as canned foods, the amount of time required to neatly stock a display unit can become extensive, thereby significantly increasing a stores overall operating expenses.

Furthermore, products are often damaged during the stocking process. For example, the cutting blades used to open shipping containers during the stocking process have been known to unintentionally cut through product. Products that have been unintentionally cut during the stocking process may be more difficult to sell and, depending on the extent of the damage, may be unfit for sale.

Accordingly, those skilled in the art continue to seek alternatives to the traditional package-ship-unpack-display model in an effort to improve operating efficiency.

SUMMARY

In one aspect, the disclosed product container and dispenser may include a housing having a plurality of walls that define an internal volume, a first wall of the housing defining an opening into the internal volume, and a partition structure positioned in the internal volume, the partition structure including a sealing wall aligned with the first wall and a partition wall connected to the sealing wall, wherein the opening is at least partially obstructed by the sealing wall.

In another aspect, the disclosed product container and dispenser may include a housing having a plurality of walls that define an internal volume, wherein a first wall of the housing defines an opening into the internal volume and includes two opposed lateral edges and two opposed longitudinal edges, and wherein the opening extends between the two opposed longitudinal edges and is positioned proximate one of the two opposed lateral edges, and a partition structure positioned in the internal volume, the partition structure including a sealing wall, a rear wall opposed from the sealing wall, and at least one partition wall extending between the sealing wall and the rear wall, the sealing wall including a pre-formed tear line that defines a first portion of the sealing wall and a second portion of the sealing wall, wherein the first portion of the sealing wall is connected to the first wall of the housing, and wherein the second portion of the sealing wall at least partially obstructs the opening.

In yet another aspect, disclosed is a method for assembling a product container and dispenser. The method may include the steps of (1) providing a container blank having a plurality of pre-formed fold lines that define at least four wall panels, at least one first end flap and at least one second end flap, wherein at least a first wall panel of the four wall panels defines an opening therein, (2) providing a partition structure having a sealing wall, a rear wall opposed from the sealing wall, and at least one partition wall extending between the sealing wall and the rear wall, (3) connecting the sealing wall of the partition structure to the first wall panel of the container blank, and (4) folding the container blank along the plurality of fold lines to form a three-dimensional body having an internal volume with the partition structure received in the internal volume.

Other aspects of the disclosed product container and dispenser and associated methods for assembling the same will become apparent from the following description, the accompanying drawings and the appended claims.

DETAILED DESCRIPTION

Figure 1:
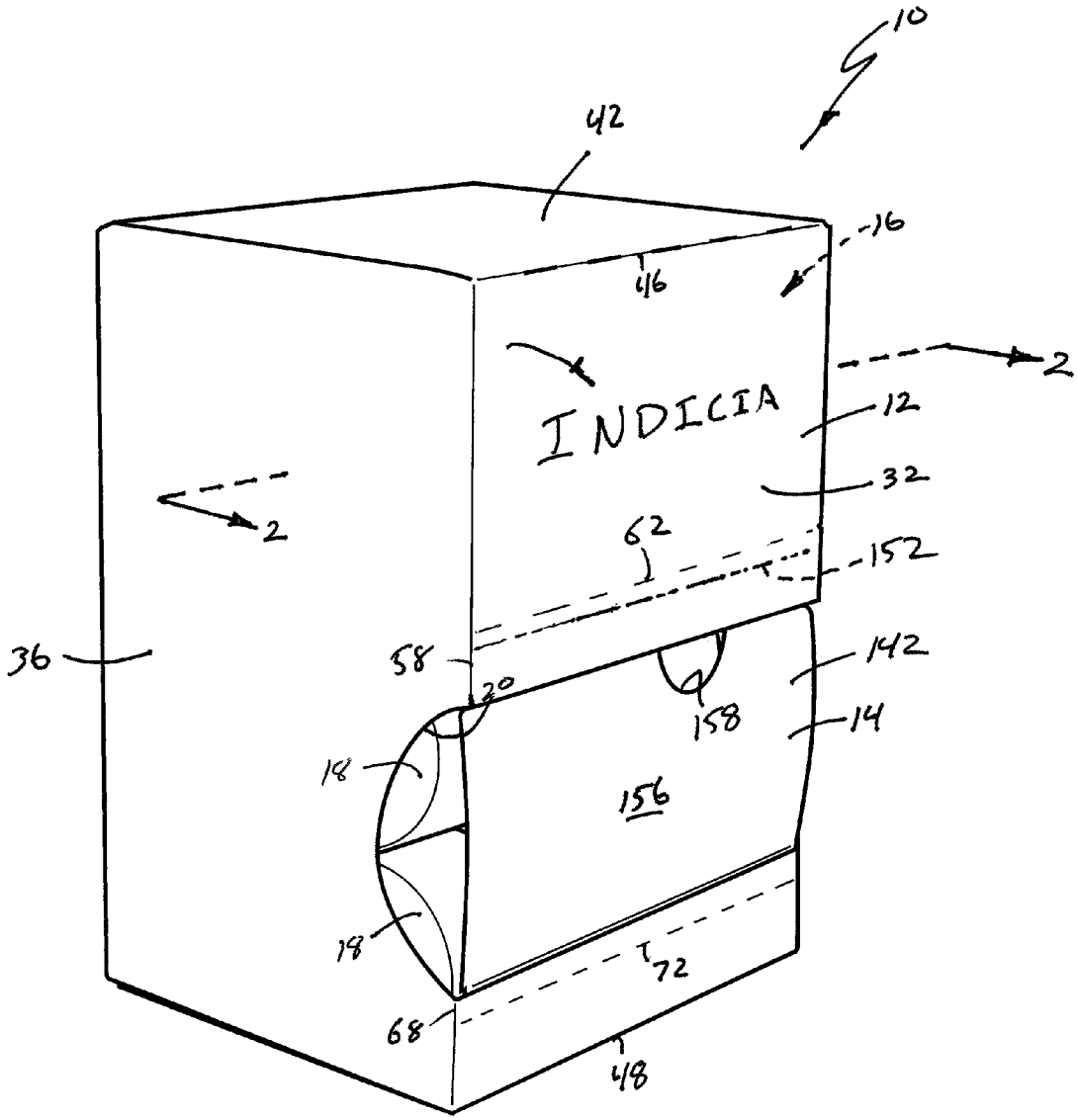
FIG. 1 is a front and side perspective view of one aspect of the disclosed product container and dispenser.
Figure 2:
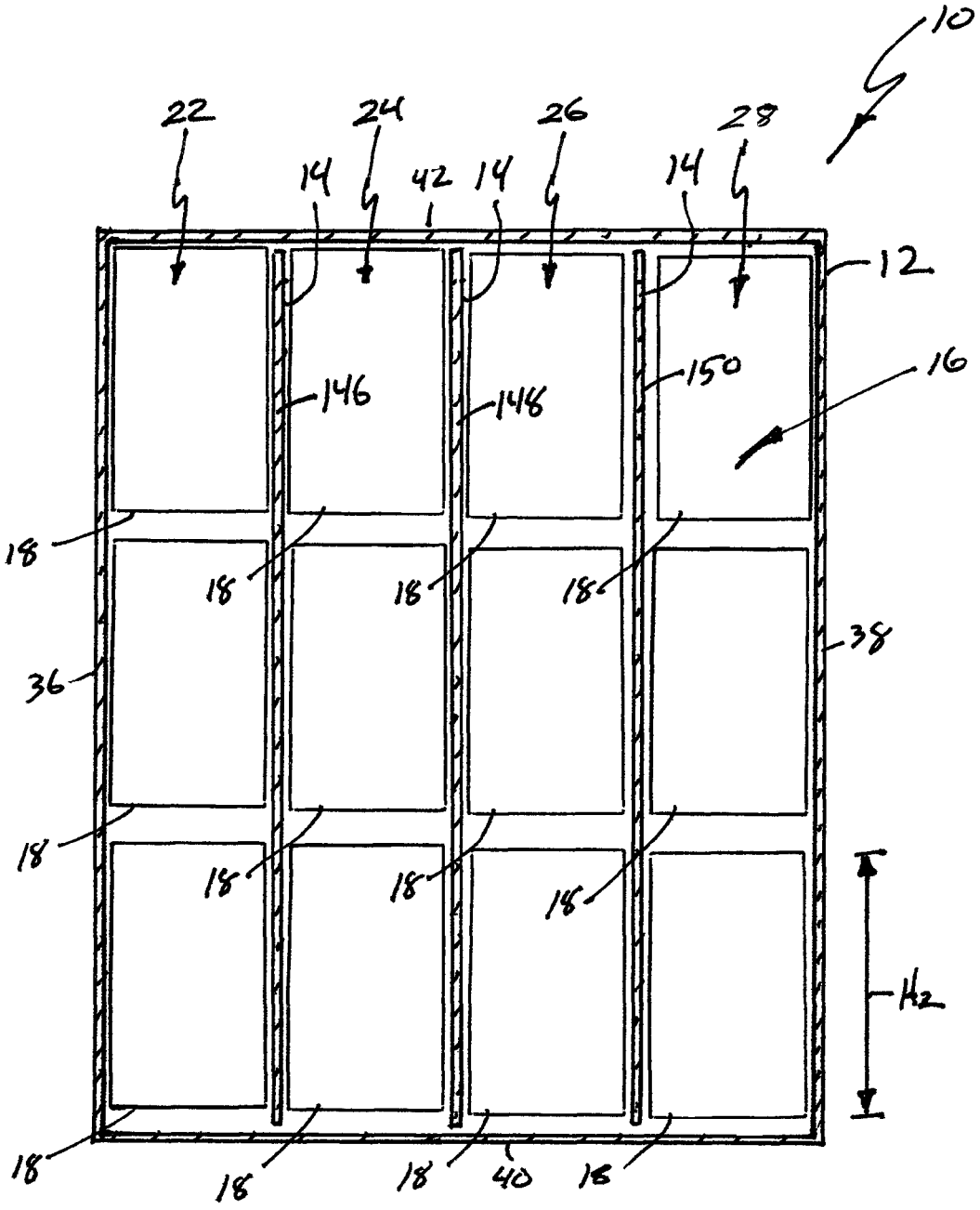
FIG. 2 is a front elevational view, in section, of the product container and dispenser of FIG. 1.
Figure 3:
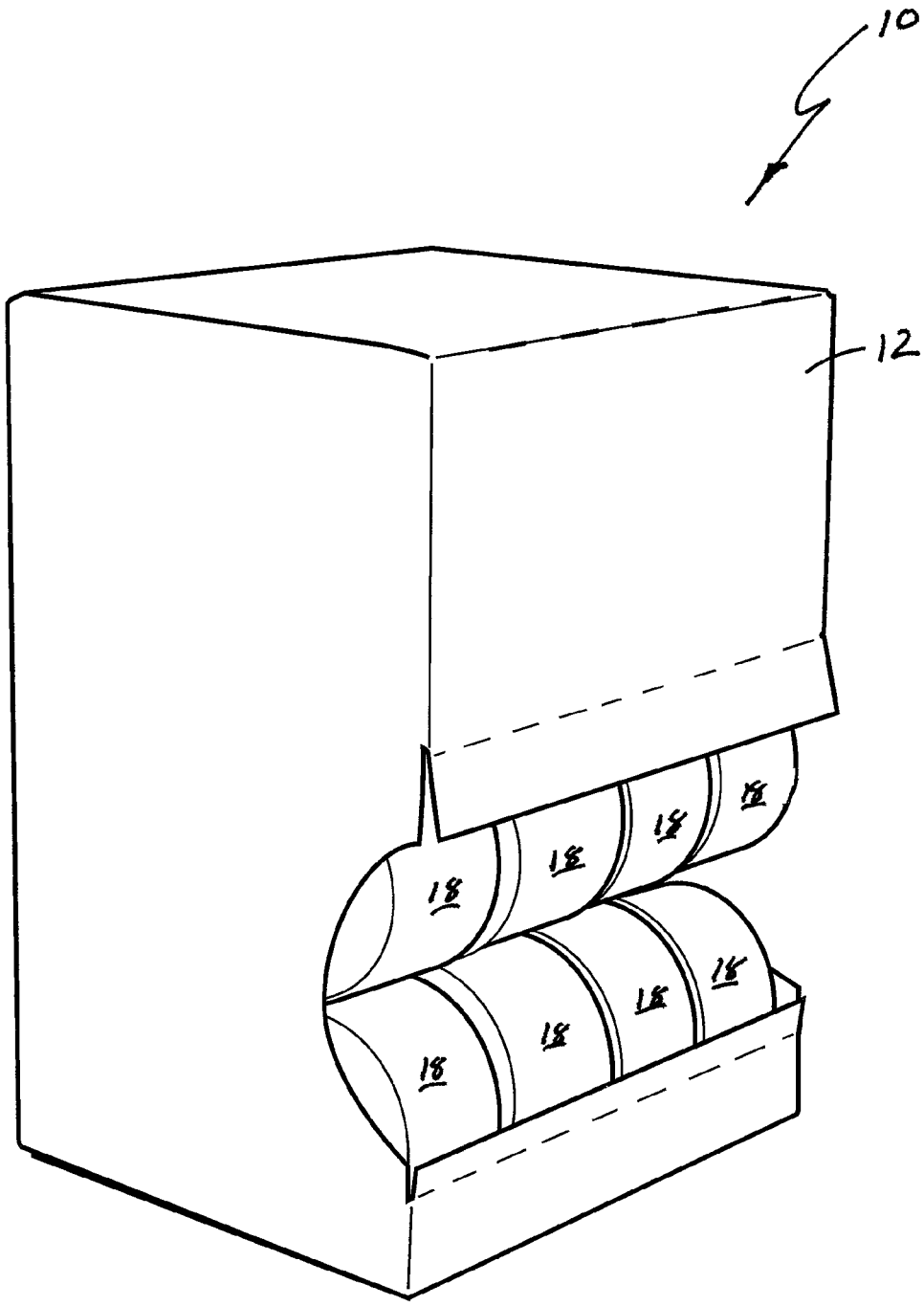
FIG. 3 is a front and side perspective view of the product container and dispenser of FIG. 1, shown in an open configuration.

Referring to FIGS. 1-3, one aspect of the disclosed product container and dispenser, generally designated 10, may include an outer housing 12 and an internal partition structure 14. The outer housing 12 may define an internal volume 16 for receiving a plurality of products 18, such as cans of food, and an opening 20 into the internal volume 16. The internal partition structure 14 may be received in the internal volume 16 of the outer housing 12 and may divide the internal volume 16 into a plurality of product chambers 22, 24, 26, 28, with each product chamber 22, 24, 26, 28 receiving a quantity of product 18.

As shown in FIG. 1, the opening 20 in the housing 12 may be sealed prior to deploying the product container and dispenser 10. In one expression, the housing 12 may include a tear-away panel (not shown) that, when removed from the housing 12, forms the opening 20 into the internal volume 16. In another expression, the opening 20 in the housing 12 may be sealed (or at least partially obstructed) with a portion of the internal partition structure 14 positioned in the internal volume 16 of the housing 12, as is shown in FIG. 1 and described in greater detail below, thereby eliminating the need for tearing and possibly damaging the housing 12. Other techniques for sealing the opening 20, such as with a peel-away label (not shown) applied to the housing 12 over the opening 20, are also contemplated.

Upon deployment, such as when the product container and dispenser 10 is positioned on a store shelve, the opening 20 in the housing 12 may be unsealed, as shown in FIG. 3. With the opening unsealed, consumers may retrieve the products 18 from the product container and dispenser 10 through the opening 20 in the housing 12.

Figure 4:
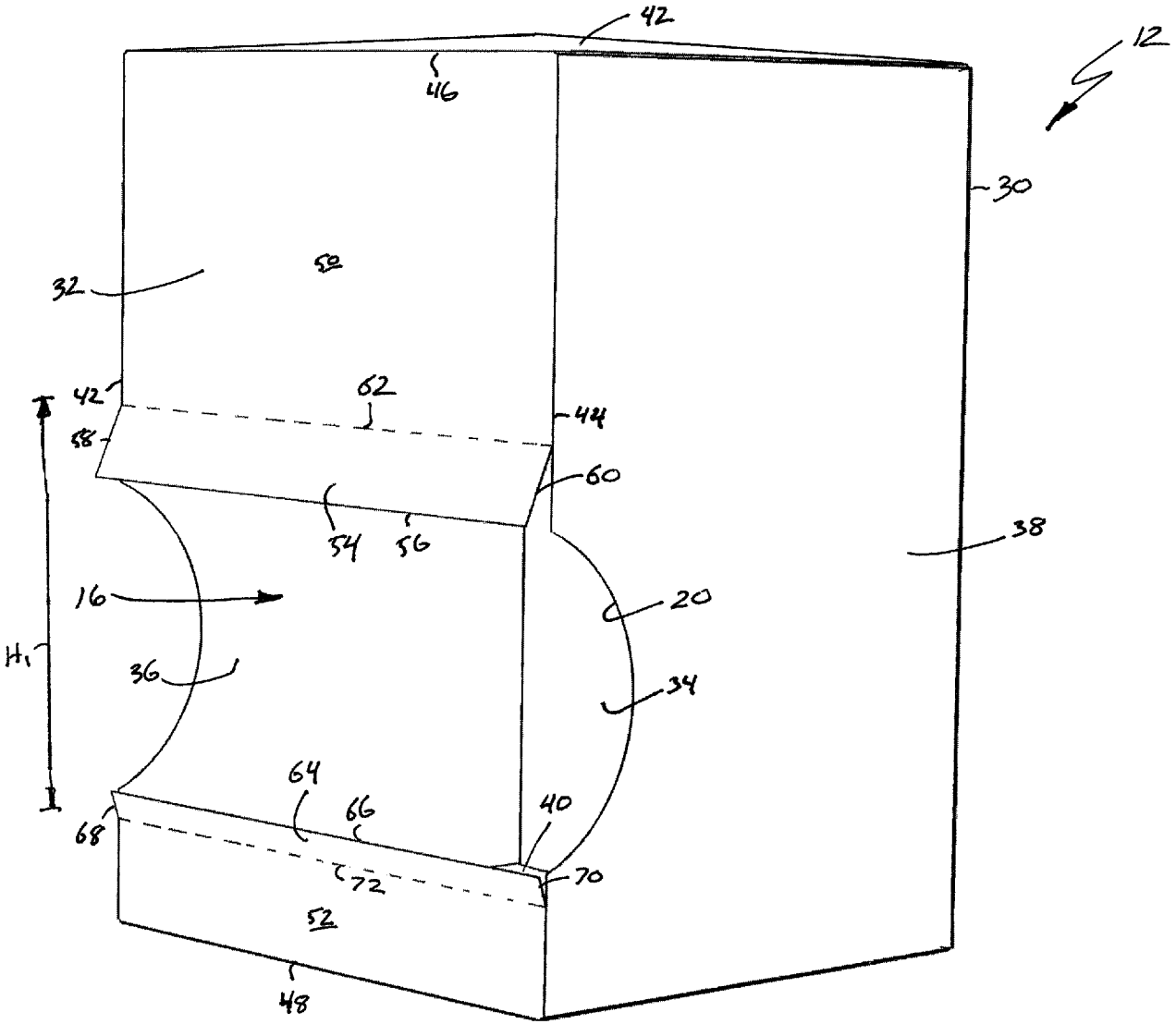
FIG. 4 is a front and side perspective view of the outer housing of the product container and dispenser of FIG. 1.

Referring to FIG. 4, the housing 12 may be formed as a three-dimensional body 30 having a plurality of walls 32, 34, 36, 38, 40, 42 that define the internal volume 16 of the housing 12. For example, the housing 12 may be formed as a three-dimensional rectilinear body 30 having opposed front 32 and rear 34 walls, opposed first (e.g., left) 36 and second (e.g., right) 38 side walls, and opposed base 40 and upper 42 walls. Those skilled in the art will appreciate that housings 12 having other shapes and configurations, such as housings 12 having non-rectangular walls, may be used without departing from the scope of the present disclosure.

The opening 20 into the internal volume 16 of the housing 12 may be formed in the front wall 32 of the housing 12. In a first construction, the opening 20 may extend only partially across the front wall 32 of the housing 12. In a second construction, the opening 20 may extend laterally across the front wall 32 of the housing 12 from a first edge 42 (i.e., the edge 42 between the front wall 32 and the left side wall 36) of the housing 12 to a second edge 44 (i.e., the edge 44 between the front wall 32 and the right side wall 38) of the housing 12. In a third construction, the opening 20 may extend from the left side wall 36, across the front wall 32, and into the right side wall 38.

The opening 20 in the front wall 32 of the housing 12 may be positioned between the upper 46 and lower 48 lateral edges of the front wall 32. Therefore, the opening 20 may divide the front wall 32 into an upper portion 50 and a lower portion 52, both of which may function to retain the products 18 (FIGS. 1-3) within the product container and dispenser 10. The spacing between the upper 50 and lower 52 portions of the front wall 32 may depend on the height $H_1$ of the opening 20, which in turn may be dictated by the height $H_2$ of the products 18 housed in the product container and dispenser 10.

The height $H_1$ of the opening 20 may be slightly greater than the height $H_2$ (FIG. 2) of the products 18 in the housing 12. Therefore, the opening 20 may be sufficiently large to allow a consumer to pull a product 18 through the opening 20, but no so large that products 18 readily fall through the opening 20.

Those skilled in the art will appreciate that products 18 (FIGS. 1-3) housed in the product container and dispenser 10 will be biased to the base wall 40 of the housing 12 due to the force of gravity. Therefore, the opening 20 in the housing 12 may be positioned proximate (i.e., at or near) the base wall 40 of the housing 12 to facilitate retrieving products 18 positioned adjacent to the base wall 40.

In one optional implementation, the upper portion 50 of the front wall 32 of the housing 12 may define a flap 54 extending along, and partially covering, the opening 20 into the internal volume 16. The flap 54 may include a lateral edge 56, which may extend along the front wall 32 between the opposed longitudinal side edges 42, 44 of the front wall 32, and two opposed side edges 58, 60 that define the height $H_3$ (FIG. 5) of the flap 54. The side edges 58, 60 of the flap 54 may be formed as slits along the longitudinal side edges 42, 44 of the front wall 32.

The flap 54 may pivot relative to the upper portion 50 of the front wall 32 along a pre-formed fold line 62. For example, the flap 54 may pivot relative to the upper portion 50 of the front wall 32 from a first position (FIG. 1), wherein the flap 54 is aligned with the front wall 32 (i.e., a plane defined by the flap 54 is co-planar with a plane defined by the front wall 32), to a second position (FIG. 4), wherein the flap 54 is disposed at a non-zero angle relative to the front wall 32 (i.e., the plane defined by the flap 54 intersects the plane defined by the front wall 32 along the pre-formed fold line 62). In the first position (FIG. 1), the flap 54 may cover a portion of the opening 20, thereby decreasing the height $H_1$ of the opening 20. In the second position (FIG. 4), the flap 54 may extend away from the opening 20, thereby increasing the height $H_1$ of the opening 20.

Additionally, the lower portion 52 of the front wall 32 of the housing 12 may define a second flap 64 extending along, and partially covering, the opening 20. The second flap 64 may include a lateral edge 66 and two opposed side edges 68, 70, and may pivot relative to the lower portion 52 of the front wall 32 along a pre-formed fold line 72. The opposed side edges 68, 70 of the second flap 56 may define the height $H_4$ (FIG. 5) of the second flap 64.

The flaps 54, 64 may function as extensions of the upper 50 and lower 52 portions, respectively, of the front wall 32. Therefore, the flaps 54, 64 may retain the products 18 (FIGS. 1-3) within the internal volume 16 of the housing 12 when the flaps 54, 64 are in the first position (FIG. 1), but may move to the second position (FIG. 4) to increase the height $H_1$ of the opening 20 when a product 18 is being withdrawn from the internal volume 16 of the housing 12 through the opening 20.

While the flaps 54, 64 are shown as continuous flaps extending entirely across the front wall 32 of the housing 12, other configurations are also contemplated. For example, each flap 54, 64 may be comprised of multiple, independently pivoting flaps and/or may extend along only a portion of the opening 20.

Figure 5:
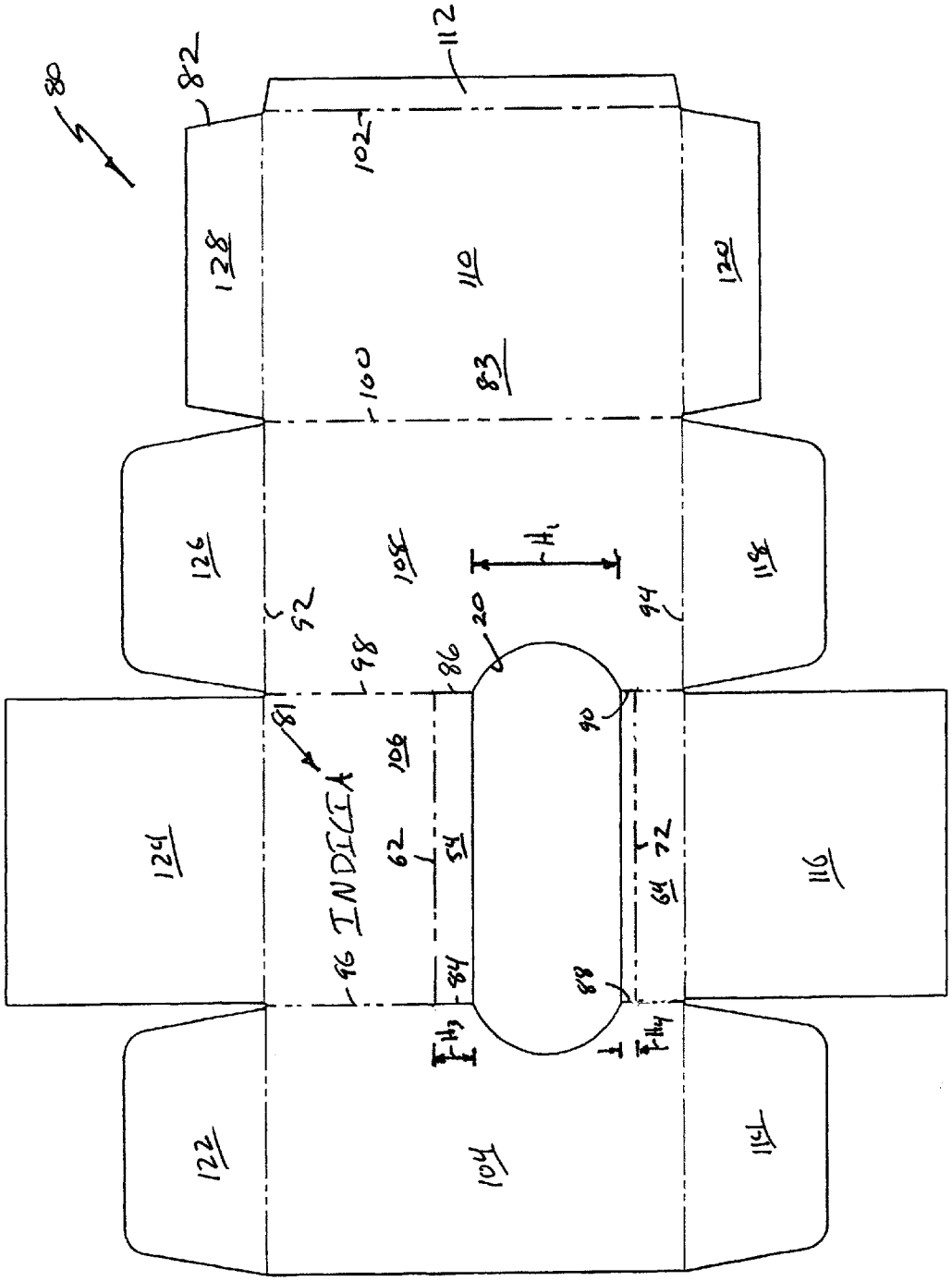
FIG. 5 is a top plan view of a container blank used to form the outer housing of FIG. 4.

The housing 12 may be formed from a container blank, such as the container blank 80 shown in FIG. 5. The container blank 80 may be cut from a sheet of stock material to define an outer periphery 82 of the container blank 80. In one particular aspect, the stock material may be a paperboard-based material, such as C1S paperboard, which may have a coating (e.g., clay) on a first major surface thereof and an uncoated second major surface, or C2S paperboard, which may have a coating (e.g., clay) on both major surfaces thereof. Optionally, at least one major surface of the container blank 80, such as the coated external surface 83, may be marked with various indicia 81, such as printed text and graphics.

The container blank 80 may include the opening 20, cuts 84, 86 that define the side edges 58, 60 of the first flap 54, the pre-formed fold line 62 of the first flap 54, cuts 88, 90 that define the side edges 68, 70 of the second flap 64, the pre-formed fold line 72 of the second flap 64, lateral pre-formed fold lines 92, 94 and longitudinal pre-formed fold lines 96, 98, 100, 102. The periphery 82 and the preformed fold lines 92, 94, 96, 98, 100, 102 may define wall panels 104, 106, 108, 110, a sealing flap 112, first end flaps 114, 116, 118, 120 and second end flaps 122, 124, 126, 128. Specifically, wall panel 104 may be defined by the periphery 82 and fold lines 92, 94, 96, and may form the left side wall 36 of the assembled housing 12 (FIG. 4), wall panel 106 may be defined by fold lines 92, 94, 96, 98, and may form the front wall 32 of the assembled housing 12, wall panel 108 may be defined by fold lines 92, 94, 98, 100, and may form the right side wall 38 of the assembled housing 12, wall panel 110 may be defined by fold lines 92, 94, 100, 102, and may form the rear wall 34 of the assembled housing 12, the sealing flap 112 may be defined by the periphery 82 and fold line 102, the first end flaps 114, 116, 118, 120 may be defined by the periphery 82 and fold line 94, and the second end flaps 122, 124, 126, 128 may be defined by the periphery 82 and fold line 92.

Thus, the housing 12 may be formed by folding the blank 80 along the lateral 92, 94 and longitudinal 96, 98, 100, 102 fold lines, connecting the sealing flap 112 to wall panel 104, assembling the first end flaps 114, 116, 118, 120 to form the base wall 40 and assembling the second end flaps 122, 124, 126, 128 to form the upper wall 42. Prior to assembling and sealing the first 114, 116, 118, 120 and/or the second 122, 124, 126, 128 end flaps, the internal partition structure 14 and the products 18 may be placed in the internal volume 16 of the housing 12, as is described in greater detail below.

Figure 6:
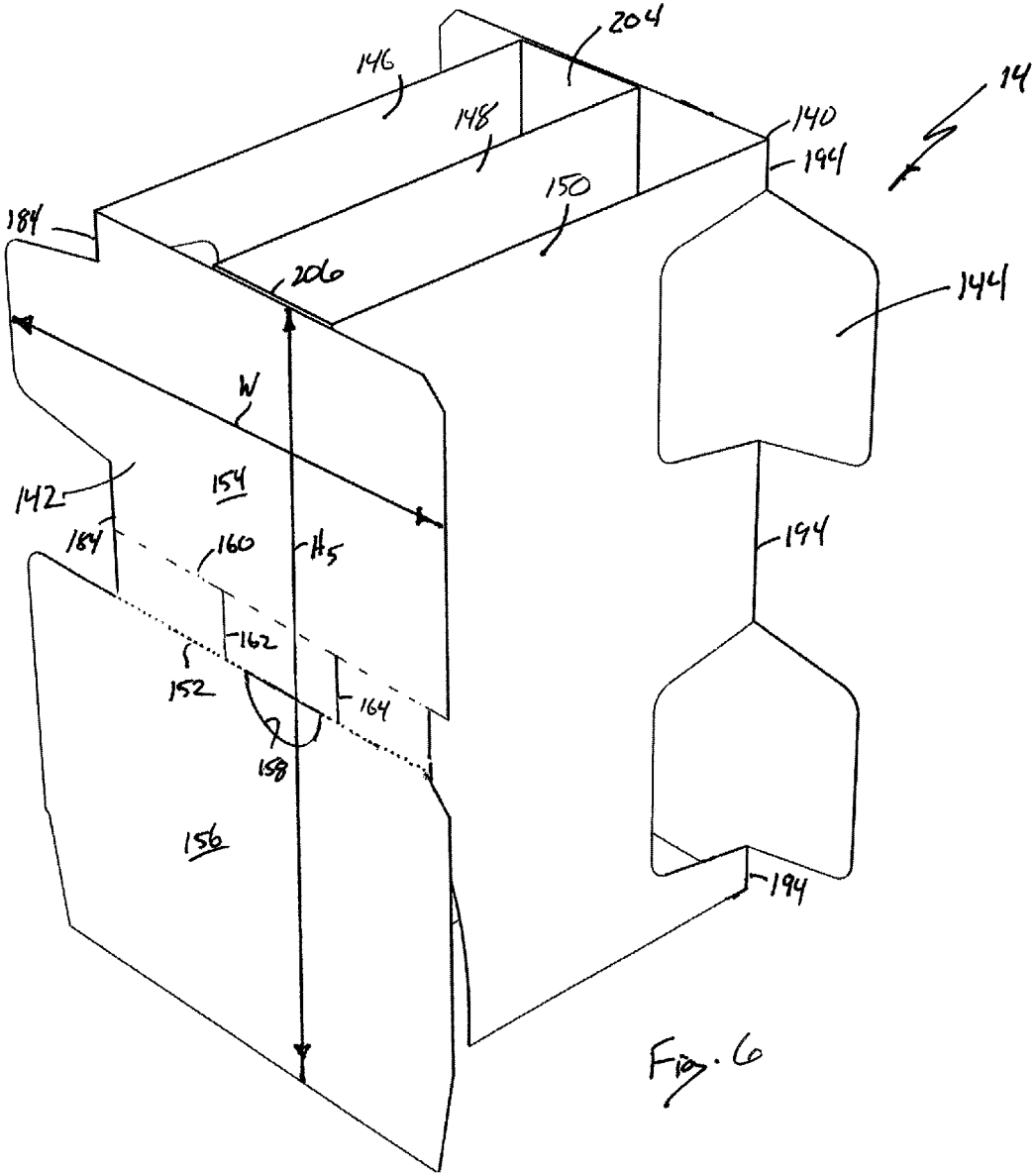
FIG. 6 is a front and side perspective view of the internal partition structure of the product container and dispenser of FIG. 1.

Referring to FIG. 6, the internal partition structure 14 may be a three-dimensional structure 140 that includes a front wall 142 (i.e., a sealing wall), a rear wall 144, and one or more partition walls 146, 148, 150. As shown in FIG. 2, the internal partition structure 14 may be positioned in the internal volume 16 of the housing 12 to define a plurality of product chambers 22, 24, 26, 28 within the internal volume 16. Optionally, as shown in FIG. 1, the internal partition structure 14 may also seal (or at least partially obstruct) the opening 20 in the housing 12.

The front wall 142 of the internal partition structure 14 may be opposed from the rear wall 144 and may include a height $H_5$ and a width W that closely correspond to the height and width of the front wall 32 (FIG. 4) of the housing 12. Optionally, a pre-formed tear line 152 may extend laterally across the front wall 142 of the internal partition structure 14 to define an upper portion 154 of the front wall 142 and a lower portion 156 (i.e., a sealing panel) of the front wall 142. As an example, the pre-formed tear line 152 may be formed as a row of perforations have a tear strength sufficient such that the pre-formed tear line 152 may be severed without the need for a cutting element.

The lower portion 156 of the front wall 142 of the internal partition structure 14 may define an opening 158 therein, such as a thumb hole. The opening 158 may be positioned proximate the pre-formed tear line 152. Therefore, a user may grasp the lower portion 156 of the front wall 142, such as by inserting a finger through the opening 158, and may tear the lower portion 156 away from the upper portion 154 along the pre-formed tear line 152, thereby removing the lower portion 156 of the front wall 142 from the internal partition structure 12, as shown in FIG. 7.

The upper portion 154 of the front wall 142 of the internal partition structure 14 may optionally include a pre-formed fold line 160 and cut lines 162, 164. As shown in FIG. 7, when the lower portion 156 of the front wall 142 is removed from the internal partition structure 14, the pre-formed fold line 160 and the cut lines 162, 164 may define flaps 166, 168, 170 extending across the upper portion 154 of the front wall 142. Flap 166 may have a width that corresponds to the width of product channel 24 (FIG. 2), and may be aligned with product channel 24 in the assembled product container and dispenser 10. Flap 168 may have a width that corresponds to the width of product channel 26 (FIG. 2), and may be aligned with product channel 26 in the assembled product container and dispenser 10. Flap 170 may have a width that corresponds to the width of product channel 28 (FIG. 2), and may be aligned with product channel 28 in the assembled product container and dispenser 10.

The partition walls 146, 148, 150 of the internal partition structure 14 may include front ends 172 connected to the front wall 142 and rear ends connected to the rear wall 144. The partition walls 146, 148, 150 may be laterally spaced to define the product chambers 22, 24, 26, 28 when the internal partition structure 14 is positioned in the housing 12, as shown in FIG. 2. Specifically, product chamber 22 may be laterally defined by the left side wall 36 of the housing 12 and partition wall 146, product chamber 24 may be laterally defined by partition walls 146, 148, product chamber 26 may be laterally defined by partition walls 148, 150, and product chamber 28 may be laterally defined by partition wall 150 and the right side wall 38 of the housing 12. While three partition walls 146, 148, 150 are shown, those skilled in the art will appreciate that the number of partition walls 146, 148, 150 may vary depending on the number of product chambers 22, 24, 26, 28 desired in the product container and dispenser 10.

Figure 7:
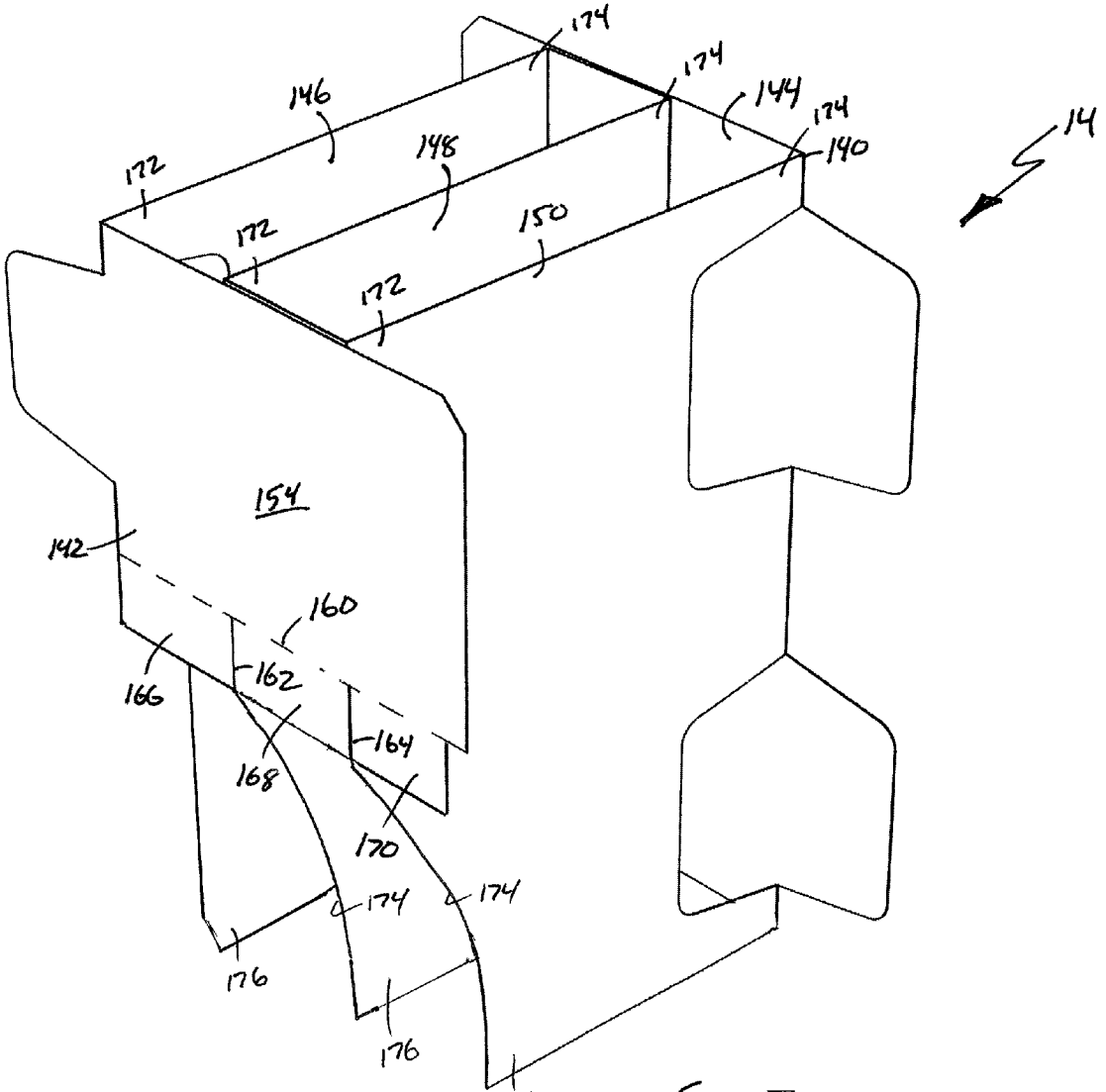
FIG. 7 is front and side perspective view of the internal partition structure of FIG. 6, shown with the sealing panel removed.

As best shown in FIG. 7, the partition walls 148, 150 may include arcuate cuts 174 such that the lower front ends 176 of the partition walls 148, 150 are displaced from the front wall 142 of the internal partition structure 14. Partition wall 146 may also be structured such that the lower front end 176 of partition wall 146 is displaced from the front wall 142 of the internal partition structure 14.

Figure 8:
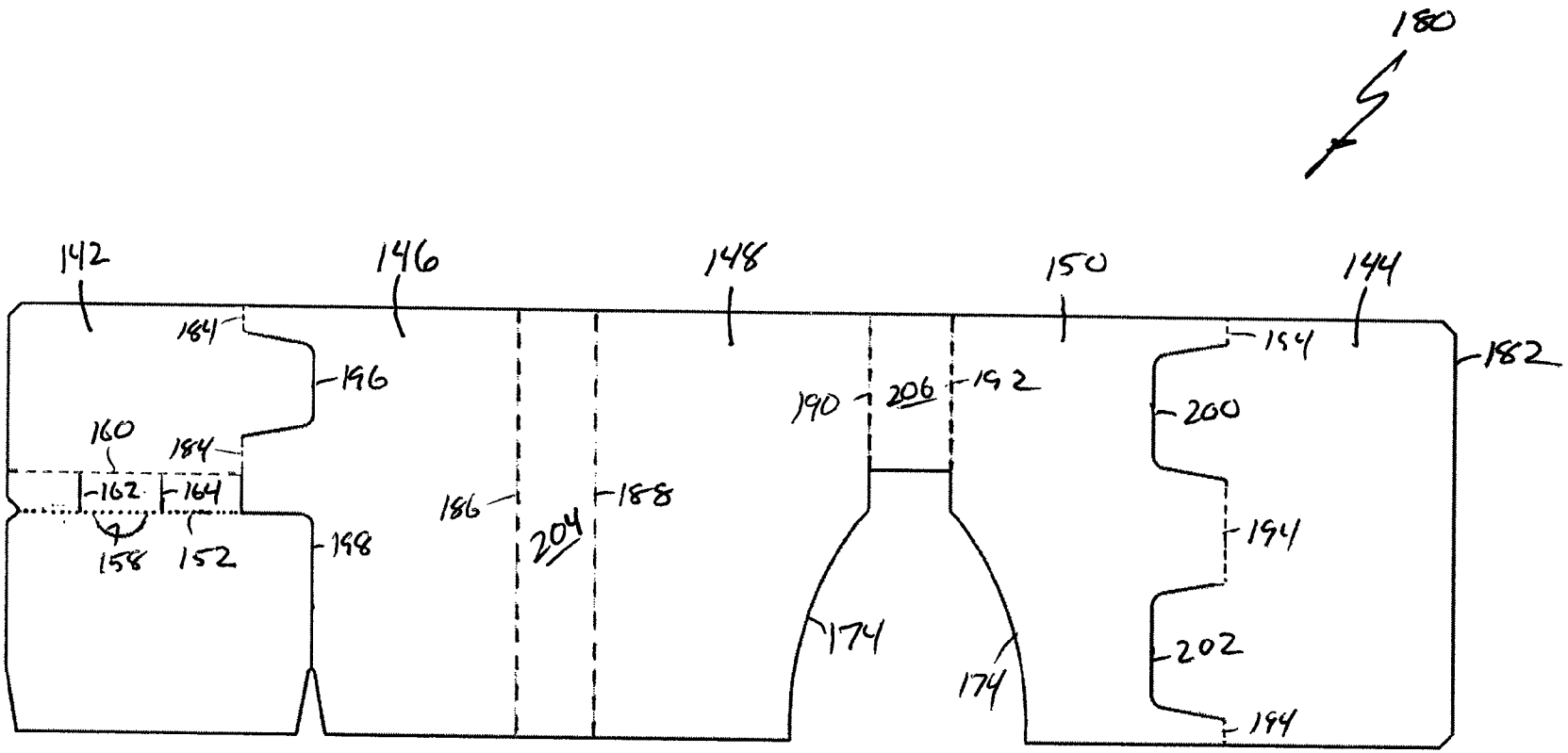
FIG. 8 is a top plan view of a container blank used to form the internal partition structure of FIG. 6.

In one implementation, the internal partition structure 14 may be formed from a blank, such as the blank 180 shown in FIG. 8. Blank 180 may be cut from a sheet of stock material to define an outer periphery 182 of the blank 180. The material used to form blank 180 may be the same (e.g., C1S paperboard) or different (e.g., a material with a lower coefficient of friction) than the material used to form the container blank 80.

The blank 180 may include a plurality of longitudinal fold lines 184, 186, 188, 190, 192, 194 (dashed lines) and a plurality of cuts 196, 198, 200, 202 (solid lines). The periphery 182 of the blank 180, fold line 184 and cuts 196, 198 may define the front wall 142 of the internal partition structure 14. The periphery 182, fold lines 184, 186 and cuts 196, 198 may define partition wall 146 of the internal partition structure 14. The periphery 182 and fold lines 186, 188 may define a first sealing panel 204 of the internal partition structure 14. The periphery 182 and fold lines 188, 190 may define partition wall 148 of the internal partition structure 14. The periphery 182 and fold lines 190, 192 may define a second sealing panel 206 of the internal partition structure 14. The periphery 182, fold lines 192, 194 and cuts 200, 202 may define partition wall 150 of the internal partition structure 14. The periphery 182, fold line 194 and cuts 200, 202 may define the rear wall 144 of the internal partition structure 14.

Thus, the internal partition structure 14 may be formed by folding the blank 180 along longitudinal fold lines 184, 186, 188, 190, 192, 194 to form the front and rear walls 142, 144, the partition walls 146, 148, 150 and the sealing panels 204, 206, connecting the first sealing panel 204 to the rear wall 144, and connecting the second sealing panel 206 to the front wall 142, as shown in FIG. 6. The connection between the sealing panels 204, 206 and walls 144, 142 of the internal partition structure 14 may be made using any available technique, such as adhesives and/or mechanical fasteners.

Referring back to FIG. 1, the product container and dispenser 10 may be assembled by positioning the internal partition structure 14 into the internal volume 16 of the housing 12 such that the front wall 142 of the internal partition structure 14 is aligned with the front wall 32 of the housing 12 and the rear wall 144 (FIG. 6) of the internal partition structure 14 is aligned with the rear wall 34 (FIG. 4) of the housing 12. When the internal partition structure 14 is positioned in the housing 12, the partition walls 146, 148, 150 may divide the internal volume 16 into four product chambers 22, 24, 26, 28, as shown in FIG. 2, and the lower portion 156 of the front wall 142 of the internal partition structure 14 may seal (or at least partially obstruct) the opening 20 in the housing 12. Therefore, product 18 may be introduced into the product chambers 22, 24, 26, 28 and may be contained within the product container and dispenser 10.

In one variation, the product container and dispenser 10 may be assembled by positioning the internal partition structure 14 into the internal volume 16 of the housing 12 such that the internal partition structure 14 is not connected to the housing 12. Those skilled in the art will appreciate that the three-dimensional shape of the internal partition structure 14 may allow the internal partition structure 14 to stand upright in the internal volume 16 of housing 12, particularly, since the internal partition structure 14 is bounded by the walls 32, 34, 36, 38, 40, 42 of the housing 12.

In another variation, the product container and dispenser 10 may be assembled by partially assembling the housing 12 to define the internal volume 16 of the housing 12 (i.e., connecting the sealing flap 112 of the container blank 80 to the wall panel 104), applying an adhesive to the exterior surfaces of the front 142 and rear 144 walls of the internal partition structure 14 (only the upper portion 154 of the front wall 142), and inserting the internal partition structure 14 into the internal volume 16 of the partially-assembled housing 12 such that the exterior surface of the front wall 142 of the internal partition structure 14 is adhered to the interior surface of the front wall 32 of the housing 12 and the exterior surface of the rear wall 144 of the internal partition structure 14 is adhered to the interior surface of the rear wall 34 of the housing 12. Then, products 18 may be introduced into the product chambers 22, 24, 26, 28 (FIG. 2) and the first 114, 116, 118, 120 and second 122, 124, 126, 128 end flaps may be assembled and sealed to form the base 40 and upper 42 walls of the housing 12.

In yet another variation, the internal partition structure 14 may be assembled and connected to the container blank 80 such that the product container and dispenser 10 is formed simply by assembling the container blank 80. Those skilled in the art will appreciate that the assembled internal partition structure 14 may be collapsed along the fold lines 184, 186, 188, 190, 192, 194 by pivoting the partition walls 146, 148, 150 relative to the front 142 and rear 144 walls to approximate the front 142 and rear 144 walls. Therefore, as an example, the collapsed internal partition structure 14 may be connected to the container blank 80 (FIG. 5) by connecting the upper portion 154 of the front wall 142 of the internal partition structure 14 to the upper portion of wall panel 106 of the container blank 80. Optionally, the rear wall 144 of the internal partition structure 14 may be pre-connected to wall panel 110 of the container blank 80. Then, as the container blank 80 is assembled to form the housing 12, the internal partition structure 14 may be automatically erected within the housing 12.

Referring to FIG. 1, the product container and dispenser 10 may be opened by grasping the lower portion 156 of the front wall 142 of the internal partition structure 14, such as by inserting a finger through the opening 158, and tearing the lower portion 156 away from the upper portion 154 (FIG. 6) along the pre-formed tear line 152. Once the lower portion 156 has been removed from the product container and dispenser 10, the opening 20 in the housing may be unsealed, thereby allowing consumers to retrieve products 18 from the internal volume 16 through the opening 20, as shown in FIG. 3.

As shown in FIG. 2, the products 18 may be vertically stacked in the internal volume 16. Therefore, with the opening 20 (FIG. 3) positioned proximate the base wall 40 of the housing 12, consumers may be inclined to remove the lowermost products 18 (i.e., products positioned adjacent to the base wall 40) through the opening 20, thereby allowing successive products 18 to move to the opening 20 under the force of gravity.

Accordingly, the disclosed product container and dispenser 10 may function as a sealed container for transporting products 18 and, when the opening 20 is formed in the housing 12, may also function as a dispenser for dispensing the products 18. The opening 20 in the housing 12 may be sealed by the internal partition structure 14, thereby avoiding the need for tearing of the housing 12 to form the opening 20, which may preserve the aesthetic visual appeal of the housing 12, particularly when the housing 12 is marked with advertising indicia. Optional flaps 54, 64 extending along the opening 20 may facilitate retention of the product 18 in the housing 12, but may also flex to avoid tearing the housing 12 as product 18 is removed from the housing 12 through the opening 20.

Although various aspects of the disclosed product container and dispenser have been shown and described, modifications may occur to those skilled in the art upon reading the specification. The present application includes such modifications and is limited only by the scope of the claims.

What is claimed is:

1. A container comprising:

a housing including a plurality of walls that define an internal volume, a first wall of said plurality of walls defining an opening into said internal volume; and a partition structure positioned in said internal volume, said partition structure including a sealing wall aligned with said first wall and a partition wall connected to said sealing wall, wherein said opening is at least partially obstructed by said sealing wall, and wherein a portion of said sealing wall at least partially obstructing said opening is removable from said partition structure.

2. The container of claim 1 further comprising a plurality of products received in said internal volume.

3. The container of claim 2 wherein said partition wall divides said internal volume into at least a first chamber and a second chamber, said first chamber receiving a first portion of said plurality of products and said second chamber receiving a second portion of said plurality of products.

4. The container of claim 1 wherein said plurality of walls form a three-dimensional rectilinear body.

5. The container of claim 1 wherein said first wall includes two opposed lateral edges and two opposed longitudinal edges, and wherein said opening extends between said two opposed longitudinal edges and is positioned proximate one of said two opposed lateral edges.

6. The container of claim 1 wherein said first wall includes a first flap partially covering said opening.

7. The container of claim 6 wherein said first flap is defined by a first pre-formed fold line formed in said first wall.

8. The container of claim 6 wherein said first wall includes two opposed lateral edges and two opposed longitudinal edges, and wherein said first flap extends between said two longitudinal edges.

9. The container of claim 6 wherein said first wall further includes a second flap partially covering said opening, said second flap being defined by a second pre-formed fold line formed in said first wall.

10. The container of claim 9 wherein said first pre-formed fold line is generally parallel with said second pre-formed fold line.

11. The container of claim 1 wherein said partition structure is connected to said housing.

12. The container of claim 1 wherein said sealing wall defines a first plane and said partition wall defines a second plane, said second plane being generally perpendicular to said first plane.

13. The container of claim 1 wherein said partition structure further includes a rear wall opposed to the first wall, said partition wall extending between said first wall and said rear wall.

14. The container of claim 1 wherein said sealing wall includes a pre-formed tear line that defines a first portion of said sealing wall and a second portion of said sealing wall, and wherein said first portion of said sealing wall at least partially obstructs said opening.

15. The container of claim 14 wherein said second portion of said sealing wall is connected to said first wall of said housing.

16. The container of claim 14 wherein said second portion of said sealing wall includes a pre-formed fold line that is generally parallel with said pre-formed tear line.

17. The container of claim 16 wherein said second portion of said sealing wall further includes at least one cut extending from said pre-formed fold line to said pre-formed tear line.

18. The container of claim 14 wherein said first portion of said sealing wall defines an opening therein.

19. A container comprising:

a housing including a plurality of walls that define an internal volume, wherein a first wall of said plurality of walls defines an opening into said internal volume and includes two opposed lateral edges and two opposed longitudinal edges, and wherein said opening extends between said two opposed longitudinal edges and is positioned proximate one of said two opposed lateral edges; and a partition structure positioned in said internal volume, said partition structure including a sealing wall, a rear wall opposed from said sealing wall, and at least one partition wall extending between said sealing wall and said rear wall, said sealing wall including a pre-formed tear line that defines a first portion of said sealing wall and a second portion of said sealing wall, wherein said first portion of said sealing wall is connected to said first wall of said housing, and wherein said second portion of said sealing wall at least partially obstructs said opening.

* * * * *